US010077405B2

(12) United States Patent
Daage et al.

(10) Patent No.: US 10,077,405 B2
(45) Date of Patent: Sep. 18, 2018

(54) PETROLEUM CRUDE OIL DESALTING PROCESS AND UNIT

(71) Applicant: ExxonMobil Research and Engineering Company, Annandale, NJ (US)

(72) Inventors: Michel Daage, Hellertown, PA (US); Magaly C. Barroeta, Tomball, TX (US); Brian D. Albert, Fairfax, VA (US); Mohsen S. Yeganeh, Hillsborough, NJ (US); Andrew P. Sullivan, Kingwood, TX (US); Jose X. Simonetty, Kingwood, TX (US); Christopher J. Wolfe, Fort McMurray (CA)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 51 days.

(21) Appl. No.: 15/297,480

(22) Filed: Oct. 19, 2016

(65) Prior Publication Data

US 2017/0037324 A1 Feb. 9, 2017

Related U.S. Application Data

(62) Division of application No. 14/279,428, filed on May 16, 2014, now Pat. No. 9,499,748.

(60) Provisional application No. 61/828,963, filed on May 30, 2013.

(51) Int. Cl.

| | |
|---|---|
| ***C10G 31/08*** | (2006.01) |
| ***C10G 21/08*** | (2006.01) |
| ***C10G 32/02*** | (2006.01) |
| ***C10G 33/04*** | (2006.01) |
| ***C10G 53/04*** | (2006.01) |

(52) U.S. Cl.

CPC ..... *C10G 31/08* (2013.01); *C10G 21/08* (2013.01); *C10G 32/02* (2013.01); *C10G 33/04* (2013.01); *C10G 53/04* (2013.01)

(58) Field of Classification Search

USPC ..... 208/179, 187, 262.1, 298; 196/46

See application file for complete search history.

(56) References Cited

U.S. PATENT DOCUMENTS

| | | | | |
|---|---|---|---|---|
| 2,830,957 A | | 4/1958 | Rhodes | |
| 4,722,781 A | | 2/1988 | Swartz et al. | |
| 4,806,231 A | * | 2/1989 | Chirinos | C10G 31/08 208/187 |

(Continued)

FOREIGN PATENT DOCUMENTS

| | | |
|---|---|---|
| WO | 92/19351 A1 | 11/1992 |
| WO | 94/16033 A1 | 7/1994 |
| WO | 02/055171 A2 | 7/2002 |

OTHER PUBLICATIONS

The International Search Report and Written Opinion of PCT/US2014/038380 dated Sep. 10, 2014.

*Primary Examiner* — Brian A McCaig

(74) *Attorney, Agent, or Firm* — Glenn T. Barrett

(57) ABSTRACT

An improved method and process unit for desalting petroleum crude oils in which a portion of the stable emulsion layer which forms in the desalter vessel is withdrawn from the desalter and diluted with a liquid diluent, typically oil or water or both to destabilize the emulsion which is then separated into separate oil and water phases.

7 Claims, 2 Drawing Sheets

(56) References Cited

U.S. PATENT DOCUMENTS

| | | | |
|---|---|---|---|
| 5,612,490 | A | 3/1997 | Carlson et al. |
| 2012/0024758 | A1 | 2/2012 | Love |

* cited by examiner

PETROLEUM CRUDE OIL DESALTING PROCESS AND UNIT

CROSS REFERENCE TO RELATED APPLICATIONS

This application is a divisional application filed under 37 C.F.R. 153(b) of parent U.S. patent application Ser. No. 14/279,428, the entirety of which is hereby incorporated herein by reference, and claims priority to U.S. Non-Provisional patent application Ser. No. 14/279,428 filed on May 16, 2014, which claims priority to U.S. Provisional Application Ser. No. 61/828,963 filed on May 30, 2013, herein also incorporated by reference in its entirety.

FIELD OF THE INVENTION

This invention relates to petroleum desalters and their operation.

BACKGROUND OF THE INVENTION

Crude petroleum contains impurities which include water, salts in solution and solid particulate matter that may corrode and build up solid deposits in refinery units; these impurities must be removed from the crude oil before the oil can be processed in a refinery. The impurities are removed from the crude oil by a process known as "desalting", in which hot crude oil is mixed with water and a suitable demulsifying agent to form a water-in-oil emulsion which provides intimate contact between the oil and water so that the salts pass into solution in the water. The emulsion is then passed into a high voltage electrostatic field inside a closed separator vessel. The electrostatic field coalesces and breaks the emulsion into an oil continuous phase and a water continuous phase. The oil continuous phase rises to the top to form the upper layer in the desalter from where it is continuously drawn off while the water continuous phase (commonly called "brine") sinks to the bottom from where it is continuously removed. In addition, solids present in the crude will accumulate in the bottom of the desalter vessel. The desalter must be periodically jet washed to remove the accumulated solids such as clay, silt, sand, rust, and other debris by periodically recycling a portion of the desalter effluent water to agitate the accumulated solids so that they are washed out with the effluent water. These solids are then routed to the wastewater system. Similar equipment (or units) and procedures, except for the addition of water to the oil, are used in oil producing fields to dehydrate the oil before it is transported to a refinery.

During operation of such units, an emulsion phase of variable composition and thickness forms at the interface of the oil continuous phase and the water continuous phase in the unit. Certain crude oils contain natural surfactants in the crude oil (asphaltenes and resins) which tend to form a barrier around the water droplets in the emulsion, preventing coalescence and stabilizing the emulsion in the desalting vessel. Finely divided solid particles in the crude (<5 microns) may also act to stabilize the emulsion and it has been found that solids-stabilized emulsions present particular difficulties; clay fines such as those found in oils derived from oil sands are thought to be particularly effective in forming stable emulsions. This emulsion phase may become stable and persist in the desalting vessel. If this emulsion phase (commonly known as the "rag" layer) does stabilize and becomes too thick, the oil continuous phase will contain too much brine and the lower brine phase will contain unacceptable amounts of oil. In extreme cases it results in the emulsion being withdrawn from the top or bottom of the unit. Oil entrainment in the water phase is a serious problem as it is environmentally impermissible and expensive to remedy outside the unit. Also, it is desirable to operate the unit with the water continuous phase as close as possible to the high voltage electrodes without risking shorting across the oil to the water so as to achieve maximum coalescence of any remaining oil droplets entrained in the water continuous phase ensuring that the withdrawn water phase is substantially oil free. If, on the one hand, the emulsion phase gets too thick the dosage of the demulsifying agent must be increased; on the other hand, if the water continuous phase gets too high or too low, the water phase withdrawal valve at the bottom of the unit called a "dump valve" must be correspondingly opened or closed to the degree necessary to reposition the water phase to the desired level in the unit and for this purpose, it is necessary to monitor the level and condition of the phases in the unit.

As described in U.S. Pat. No. 5,612,490 (Carlson et al), this has traditionally been done manually by operators periodically opening trycock valves to withdraw samples from fixed levels inside the desalter by using a "swing arm" sample line in the unit in place of, or in addition to, the trycock valves. In either case, an operator opens a sample valve to withdraw a sample and runs it over a smooth surface such as metal to visually determine if the withdrawn phase is oil or water continuous or if it is a stable emulsion phase. No accurate quantitative information is available using this method and, further, because desalters typically operate at temperatures ranging between about 90 to 150° C. and pressures from 5 to to 50 barg (dehydrators typically run at lower temperatures and pressures), there is a danger of the sample flashing and burning the operator. Also, the withdrawn sample may be different in phase identity at the reduced temperature and pressure outside the unit than it is inside the unit. Other methods include the use of Agar probes or capacitance probes, some of which can give information about the water content of an oil phase, while others merely indicate if the phase is oil or water continuous.

U.S. Pat. No. 5,612,490 describes an improved desalter operation in which the level of the water continuous phase is determined by first withdrawing a liquid sample from a known level within said equipment and passing it outside, and measuring an electrical property of the withdrawn sample outside the desalter to determine if the sample is drawn from the oil phase or the water phase. These steps are repeated as many times as desired by using the existing sample withdrawal equipment to withdraw additional samples from different known vertical positions or levels in the unit to obtain a profile of the phase levels in the unit. While this method offers certain advantages, it is time-consuming, expensive in terms of the labor requirements to withdraw the samples and test their electrical properties in separate equipment, and still does not remove the safety risk to the operators discussed above sample flashing and burning)

Another problem encountered during desalter operation is that the feed mixture of oil and water may, depending upon the type of crude or combination of crudes as well as the length of time during which the oil and water remain in contact in the desalting process, the conditions in the desalter, the proportion of solids in the crude and other factors, form a stable emulsion layer which accumulates progressively in the desalter vessel. This emulsion layer in the separator vessel may vary in thickness from several centimeters to more than one meter. When an excessive stable emulsion layer builds up, it becomes necessary to withdraw the emulsion layer and process it for reintroduction into the refinery.

It is desirable to maintain a constant amount of emulsion in the separator in order to maximize the separation capacity and reduce the contamination of the outgoing oil and water. If the emulsion layer becomes too thick, excessive electrical loading, erratic voltage readings, or carryover of water into the oil or loss of oil into the water layer may result. Traditional remedies included adding chemical emulsion breakers, reducing processing rates, shutting down the desalter to remove the emulsion and increasing the size of the separator tank. These responses are inadequate with many crude oils that are processed today, especially if higher rates of processing are required. Shutdown or reduction of feed rate is therefore uneconomic while the use of chemical demulsifiers may cause problems in downstream catalytic units sensitive to deactivation by the chemicals. Formation of a stable emulsion "rag" layer can therefore lead to early shutdown of the desalting processes, causing serious disruption of refinery operation, including premature shut down, deactivation of catalysts, and the fouling/plugging of process equipment.

Processing crudes with high rag layer formation tendencies in the current desalter configurations may cause poor desalting (salt removal) efficiency due to solids build up at the bottom of the vessel, and/or a solid-stabilized rag layer leading to erratic level control and insufficient residence time for proper water/oil separation. Solids stabilized emulsion layers have become a major desalter operating concern, generating desalter upsets, increased preheat train fouling, and deteriorating quality of the brine effluent and disruption of the operation of the downstream wastewater treatment facilities.

While none of the current desalter configurations have the capability to remove the emulsion layer for treatment and reintroduction into the refinery, US 2012/0024758 (Love) proposes a technique in which the thickness of the emulsion "rag" layer is withdrawn from the separator vessel at a rate that maintains the height of the emulsion layer approximately constant so as to permit withdrawal of the rag layer at a fixed level from the vessel. The withdrawn emulsion is then processed outside the vessel through a stacked disk centrifuge. While this method has the advantage of handling the troublesome rag layer so as to maintain proper functioning of the separator, it is not optimally adapted to continuous desalter operation since it requires the fixed location of the emulsion layer to be determined by existing techniques such as those described briefly above. For this reason, use of the method may be uncertain, time-consuming or expensive and, in the event of changes in crude composition, problematical as a result of variations in the thickness or position of the emulsion layer which cannot be readily accommodated.

Co-pending U.S. Provisional Patent Application Ser. No. 61/774,937, filed on 8 Mar. 2013, now U.S. patent application Ser. No. 14/185,212, filed on Feb. 20, 2014 describes an improved mode of desalter operation in which provides for withdrawal of a portion of the emulsion layer from the desalter vessel through one or more external withdrawal headers according to the thickness and position of the emulsion layer with the selected withdrawal header(s) being controlled by sensors monitoring the position and thickness of the emulsion layer. The withdrawn emulsion layer is then routed as such or with the desalter water effluent to a settling tank or directly to another unit for separation and reprocessing.

SUMMARY OF THE INVENTION

We have now developed an improved technique for treating the emulsion layer withdrawn from the desalter vessel in order to separate it into its oil and water components along with any solids brought along with it. This treatment comprises diluting the withdrawn emulsion with added water or oil to destabilize the emulsion and permit its subsequent separation.

The desalting method of the invention is operated in a desalting unit by mixing a crude oil to be desalted with desalting water and passing the mixture of oil and water to a desalter vessel to form (i) a settled water layer containing salts dissolved from the oil in the lower portion of the vessel, (ii) a settled supernatant, desalted oil layer in the upper portion of the vessel with (iii) an intervening emulsion layer formed from the oil and the water. A portion of the emulsion is withdrawn through one or more withdrawal ports or headers and diluted with an added fluid, typically water or an added hydrocarbon feedstock, to destabilize the emulsion which is then separated, optionally with the aid of an electrostatic precipitator in a separator vessel which itself may be a desalter type vessel operating with a high voltage electric filed to facilitate the separation.

The desalter unit in which the process may be operated comprises: (i) a desalter vessel having a feed inlet for admitting a mixture of crude oil to be desalted with desalting water to form a settled water layer containing salts dissolved from the oil in the lower portion of the vessel, a settled supernatant desalted oil layer in the upper portion of the vessel and an emulsion layer formed from the oil and the water between the settled water layer and the settled oil layer, (ii) a water outlet at the bottom of the vessel for removing water from the water layer, (iii) an oil outlet at the top of the vessel for removing desalted oil from the oil layer, (iv) one or more emulsion outlets for removing emulsion from the emulsion layer, (v) a mixer connected to the emulsion outlet(s) for mixing the withdrawn emulsion with added fluid, usually water or petroleum hydrocarbons, (vi) a settling vessel connected to the mixer for allowing the mixture of withdrawn emulsion and added fluid to separate into oil and water phases.

The unit may conveniently be operated with the emulsion withdrawal system described in co-pending U.S. Provisional Patent Application Ser. No. 61/774,937 filed on Mar. 8, 2013 now U.S. patent application Ser. No. 14/185,212, filed on Feb. 20, 2014, to which reference is made for a description of the unit and its operation. In the unit described there, a level sensor system is used to indicate a lower interface between the top of the water layer and the bottom of the emulsion layer and an upper interface between the top of the emulsion layer and the bottom of the oil layer to regulate a water outlet control valve at the bottom of the desalter vessel in accordance with the water level indicated by means of the sensor so that the bottom of the emulsion layer is maintained above a minimum water level. A plurality of vertically spaced emulsion outlets is provided for removing emulsion from the emulsion layer with an emulsion outlet valve on each of the emulsion outlets which is operable by the level sensor system to regulate the emulsion outlet valve in accordance with the emulsion level indicated by the level sensor system so that at least one of the emulsion outlet valves is opened to remove emulsion from the vessel when the top of the emulsion layer in the vessel rises to the maximum emulsion level in the vessel. In the present case, the emulsion outlets conduct the withdrawn emulsion to the mixer where the additional water or oil is added to destabilize the emulsion and permit its separation.

DRAWINGS

DETAILED DESCRIPTION

Figure 1:
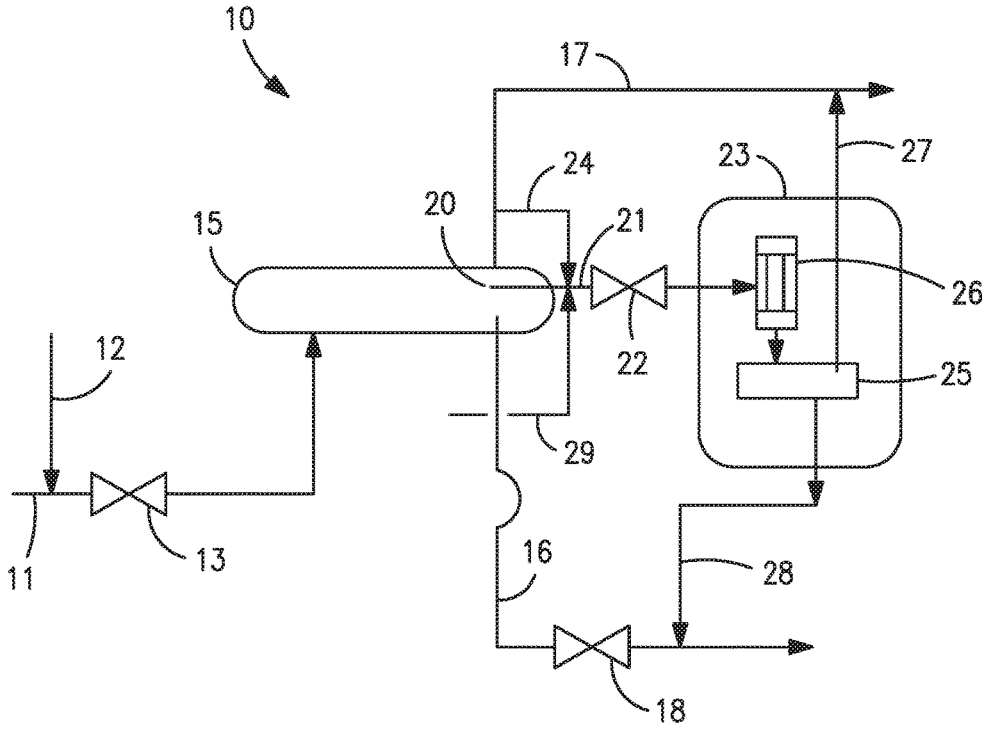
FIG. 1 is a simplified diagram of a petroleum crude desalter unit with a fluid mixer for withdrawn emulsion and a separator for the mixture.

In its most common form with electrostatically induced separation in the settler vessel, the desalting process first mixes the crude or crude blend with water using a mixing valve or other equivalent device to produce an oil/water emulsion to ensure good contact between the oil and the water to favor removal of soluble salts by the water as well as promoting separation of separated solids. The resulting emulsion is then exposed to an electric field to initiate the coalescence of the water droplets inside of the desalter vessel or separator. With time, the feed emulsion separates into an aqueous phase, an oil phase, and a solids phase which settles to the bottom of the vessel and is withdrawn there. The aqueous phase contains salts and suspended solids derived from the crude oil. The oil phase is recovered as desalted crude, from the top of the desalter vessel and normally is sent to an atmospheric distillation unit for further processing into feedstocks for motor fuel, lubricants, asphalt and other ultimate products and uses such as petrochemical production. The aqueous phase is further processed in a water treatment plant. Depending upon the crude or combination of crudes and the mixing intensity, an excessive stable emulsion (rag) layer may form in between the oil phase and the aqueous phase. Typically, this emulsion layer which contains 20 to 70% v/v water accumulates until it becomes too close to the electrodes of the desalter. This uncontrolled growth, if continued, may ultimately short out the electrodes, resulting in a complete shutdown of the desalter with a loss of oil and water separation. If, simultaneously the emulsion layer is allowed to grow downwards, an unacceptable oil contamination of the aqueous phase may ensue, exceeding the capability of the associated water treatment plant to process the brine to an acceptable environmental quality. Prudent operating practice therefore calls for the water level to be maintained at a substantially constant level in the vessel.

Conventionally, the practice is to process the crude with a single stage desalter. Some units operate with two separator vessels in series where the water is cascaded counter currently to the crude to maximize salt removal. The separator vessel typically uses gravity and electric charge to coalesce and separate oil and water emulsions into the oil and the wastewater effluent. Separators are available from a variety of commercial sources.

The wash water used to treat the crude oil may be derived from various sources and the water itself may be, for example, recycled refinery water, recirculated wastewater, clarified water, purified wastewater, sour water stripper bottoms, overhead condensate, boiler feed water, clarified river water or from other water sources or combinations of water sources. Salts in water are measured in parts per thousand by weight (ppt) and range from fresh water (<0.5 ppt), brackish water (0.5-30 ppt), saline water (30-50 ppt) to brine (over 50 ppt). Although deionized water may be used to favor exchange of salt from the crude into the aqueous solution, de-ionized water is not normally required to desalt crude oil feedstocks although it may be mixed with recirculated water from the desalter to achieve a specific ionic content in either the water before emulsification or to achieve a specific ionic strength in the final emulsified product. Wash water rates may be between approximately 5% and approximately 7% by volume of the total crude charge, but may be higher or lower dependent upon the crude oil source and quality. Frequently, a variety of water sources are mixed as determined by cost requirements, supply, salt content of the water, salt content of the crude, and other factors specific to the desalting conditions such as the size of the separator and the degree of desalting required.

A portion of the emulsion layer which forms in the desalter vessel is removed from the vessel for separate processing by the addition of a fluid which dilutes and destabilizes the emulsion to form separate aqueous and oil phases which can be separated by their density differences, e.g. by settling under gravity, centrifugal separation, atomization and partial heating followed by gravity settling/centrifugal separation, ultrasonic disruption followed by gravity settling/centrifugal separation, electrostatic coalescence and settling. Preferably, all or part of the withdrawn emulsion layer is taken to a settler tank following the addition of the destabilizing fluid to resolve the mixture of emulsion and added fluid into its two constituent phases. If necessary, separation can be facilitated by the addition of demulsifiers or other means. Additional water may be added to the settler if this will improve resolution of the withdrawn emulsion.

The emulsion may be withdrawn from the desalter vessel through a single port or header in the desalter vessel or separator or through multiple emulsion withdrawal ports or headers located at different vertical heights on the vessel as described in U.S. Provisional Patent Application Ser. No. 61/774,937. This option has the advantage that it permits the emulsion to be withdrawn selectively according to its position in the vessel and its thickness, i.e. its vertical extent in the vessel and, correspondingly, its composition since the lower portion of the emulsion layer next to the water layer contains a higher proportion of water than the portion lying next to the supernatant oil layer. The composition of the withdrawn layer can therefore be selected using the appropriate withdrawal port or ports to optimize the breaking of the emulsion by the added destabilizing fluid. In addition, selective use of the withdrawal ports enables the thickness of the emulsion layer and its position in the desalter vessel to be optimally regulated.

Depending upon the crude or combination of crudes and the mixing intensity, the emulsion layer may form between the oil phase and the aqueous phase in the desalter vessel. Crudes with high solids contents present a particularly intractable problem since the presence of the solids, often with particle sizes under 5 microns, may act to stabilize the emulsion, leading to a progressive increase in the depth of the rag layer with the stability of the emulsion varying inversely with decreasing particle size. The present invention is especially useful in its application to challenged crudes containing high levels of solids, typically over 5,000 ppmw but it may also be applied to benefit the desalting of high asphaltene content crudes which also tend to stabilize the emulsion layer in the desalter.

During the desalting process, the thickness of the emulsion layer will increase if no measures are taken to withdraw it from the vessel. The top of the emulsion layer must not, as noted above, exceed a certain fixed height in the vessel if arcing or shorting from the electrodes of the desalter is to be avoided. The rate of water addition is determined by the gravity of the crude oil. Equally, the need to maintain a certain volume of water in the vessel presents a requirement to maintain the thickness and position of the emulsion layer within certain predetermined limits. The position of the emulsion layer cannot be controlled by varying the rate of water addition independently of the oil rate so that if the thickness or position of the emulsion layer is to be varied by control of the flow rate of the oil, the water rate has to be adjusted accordingly.

The composition of the emulsion layer is not constant but varies with height in the vessel: at the bottom, where the layer meets the water, the oil/water ratio is at a low level while at the top of the layer next to the oil layer, the emulsion has a relatively higher oil/water ratio. For optimal operation, the emulsion which is being withdrawn from the vessel should not have excessive amounts of water or oil in it. The emulsion has to be processed to recover as much oil as possible and for this reason, excessive amounts of water will complicate the processing of the withdrawn emulsion and similarly, since the water which is removed from the emulsion has to be fit for ultimate discharge after necessary processing, excessive amounts of oil will also complicate processing. As a typical guideline, it is preferred that the water content of the emulsion layer withdrawn from the vessel will be from about 20 to about 70 volume percent with up to about 15,000 ppmw solids (organic and inorganic) although different values may be used according to the needs of the desalter, the capabilities of the emulsion processing unit, the waste water treatment unit, and the salt levels permissible in the downstream oil processing units. Because the thickness of the emulsion layer varies with time and processing conditions absent any control being taken, the optimal levels at which an emulsion of the appropriate oil/water ratio can be withdrawn will vary correspondingly. Withdrawal can be effected both batchwise (intermittently) and continuously. Batchwise withdrawal can be an effective technique and can be used when the water content of the emulsion layer is consistently under 20 volume percent but continuous withdrawal at a rate dependent upon the oil and water flow rates and the rate of emulsion generation is generally to be preferred, consistent with modern plant practice so as to maintain constant oil and water composition and desalting.

FIG. 1 is a simplified diagram of a petroleum crude desalting unit according to the invention using a single emulsion withdrawal port. The desalter unit 10 receives crude oil through line 11 and water through line 12; the oil and water are mixed together vigorously in mixing valve 13 and the mixture then passes into desalter vessel or settler 15 where the oil and water layers separate under the influence of an electrostatic field induced by high voltage electrodes in the top of the vessel (not shown as conventional). The brine containing dissolved salts and some solids is removed from the bottom of the vessel through line 16 under the control of a water outlet control valve 18 linked to a water level probe (not shown) situated inside the vessel. The separated, desalted oil is taken from the top of the vessel through line 17 and sent to the next refining unit in sequence in the refinery. An emulsion layer removal header 20 is inserted into vessel 15 at an appropriate level to allow the withdrawal of a portion of the emulsion layer during the normal desalting operation.

Emulsion withdrawal header 20 is connected to line 21 in which the withdrawn emulsion is mixed with added destabilizing fluid before passing through optional mixing valve 22 before being sent to emulsion treatment unit 23 where it is separated into oil and aqueous phases. If the desalted oil is selected as the diluent/destabilizing fluid, it may be taken directly from the desalted crude oil in the upper portion of the desalter vessel 15 or from line 17 by way of line 24 as shown. Alternatively, an oil diluent/destabilizing fluid may be taken from a supply of oil of suitable composition, as described below. If water is to be used to dilute and destabilize the emulsion, it may be supplied through line 29 with various options on the source of the supply as further described below.

Separation of the emulsion in separation unit 23 is effected by passing the diluted emulsion into a settling tank 25 with an optional preliminary treatment in electrostatic coalescer system 26. If the quality of the oil recovered from the diluted emulsion is acceptable, it can be blended with the primary desalted oil in line 17 by way of line 27; the separated water is conducted to the brine effluent line 16 by way of line 28 to be sent to the water treatment plant (WWT, not shown).

Separation unit 23 may operate using various methods including, but are not limited to: centrifugal separation, full vaporization of the emulsion layer water, atomization and partial heating followed by gravity settling/centrifugal separation, recycle of the layer to the desalter feed, filtration separation of the layer, membrane-enhanced separation, ultrasonic disruption followed by gravity settling/centrifugal separation, dilution with a hydrocarbon stream followed by gravity settling/centrifugal separation, dilution with a hydrocarbon stream followed by electrostatic coalescence and settling separation. A favorable method of emulsion separation with solids-stabilized emulsions is by centrifugation using a decanter centrifuge. Decanter centrifuges, which combine a rotary action with a helical scroll-like device to move collected solids along and out of the centrifuge bowl, are well adapted to handling high solids emulsions, including those with solids up to about 1 mm particle size and are available in two or three phase types (one liquid phase plus solid or two liquid phase plus solid). Depending on conditions, solids contents up to 25 weight percent can be tolerated by this type of unit although in most cases, the emulsion layer will not have more than 10 weight percent solids. The decanter centrifuge is capable of efficiently removing the liquids from the solids by the compacting action which takes place as the solids are progressively forced down the tapered portion of the rotating bowl towards the solids discharge port while the oil and water can be separately discharged as a single phase or as two separate phase from the opposite end of the bowl. If further separation of the oil and water is required to provide optimal clarification of the liquid phase, a stacked disk centrifuge may be used with its enhanced liquid treatment capability.

Figure 2:
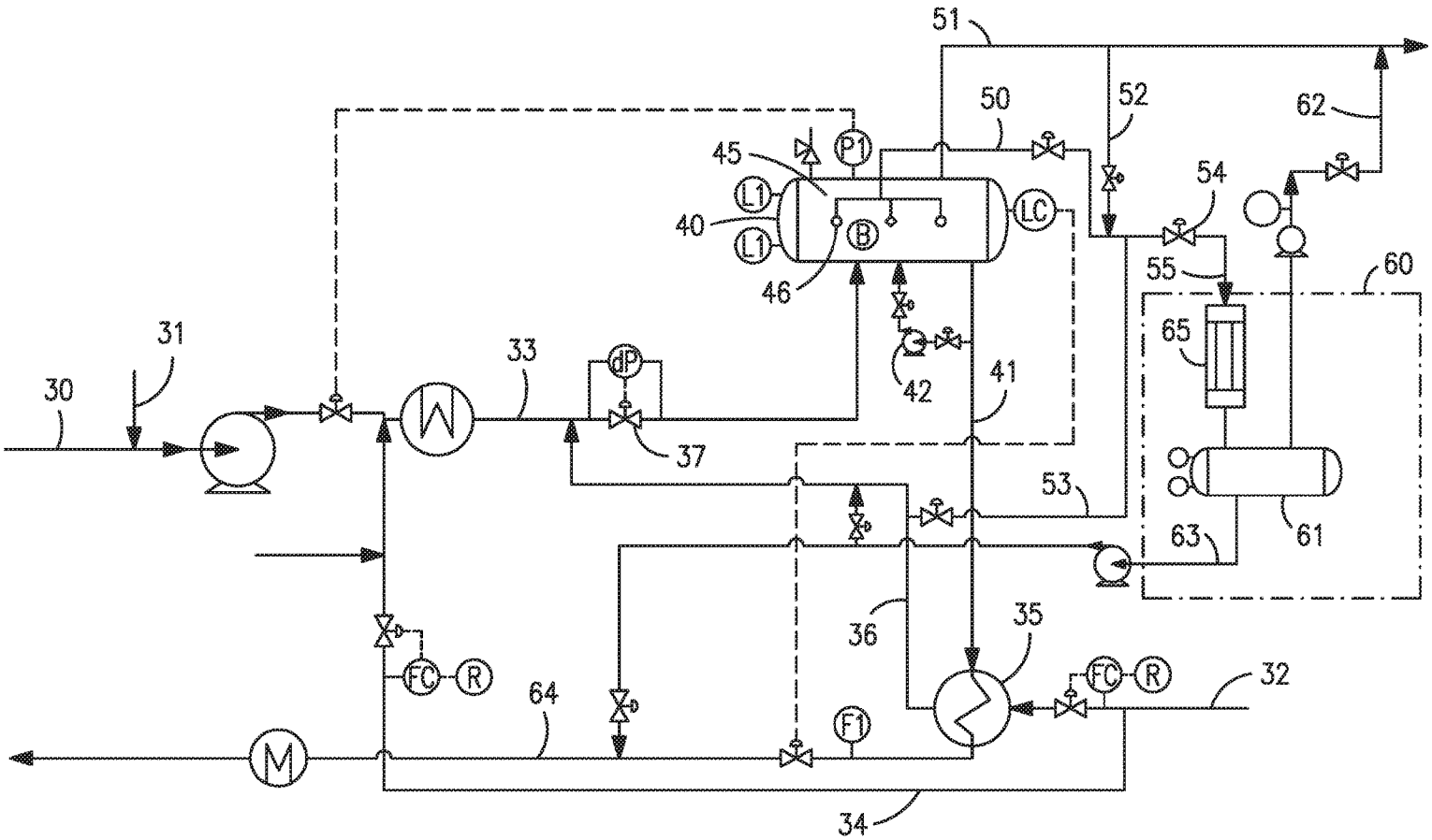
FIG. 2 is a simplified but more detailed diagram of a petroleum crude desalter unit with a fluid mixer for withdrawn emulsion and a separator for the mixture.

A more detailed schematic of the process is provided in FIG. 2. The crude feed enters through line 30 with an optional injection of demulsifier (when required) taking place though line 31. Wash water enters the unit through line 32 and is mixed with the crude oil feed in line with the option of passing directly into line 33 by way of line 34 or via heat exchanger 35 and line 36 to provide heat exchange with the brine leaving the desalter vessel 40 through line 41. The oil and wash water are mixed with the aid of mixing valve 37 which provides an emulsion of oil and water, ensuring good liquid/liquid contact between the two phases to promote removal of salts into the water. The resulting emulsion then passes into desalter vessel 40 for separation into oil and water (brine) phases under the influence of an electrostatic field at which time, the bulk of suspended solids falls into the water phase and can be removed from the bottom of the desalter vessel. A mud wash pump 42 may be provided to agitate the solids mass which accumulates in the desalter to permit it to be removed with the brine effluent stream or in periodic tank washing operations.

One or more external emulsion removal header(s) 45 is inserted into the desalter vessel 40 to allow the withdrawal of at least part of the emulsion layer during the desalting operations. Optionally, multiple headers may be used either at the same or at different vertical locations in the vessel as described above and each header may be connected to one or more withdrawal nozzle(s) 46, again at one or more vertically spaced locations in the vessel. Desalted crude oil leaves the vessel through line 51. Emulsion withdrawal header 45 is connected to line 50 and the withdrawn emulsion is mixed with the diluent/destabilizing fluid in this line. If desalted oil from line 51 is used as the diluent, it enters by way of line 52; if water is used as the diluent, it enters line 50 from line 53. The diluent or diluents are added through a mixing device 54 (or devices) preferably located at the intersection of lines 50, 52 and 53. The mixing device may comprise at least one mixing valve e.g. one valve to mix water and emulsion and another to mix oil and emulsion, or a static mixer. Optionally the mixing valve is designed to mix three or more streams simultaneously to provide operational flexibility.

The diluted emulsion is then sent through line 55 to secondary separation sub-unit 60 which includes a separator 61, where a secondary aqueous phase and a secondary oil phase is formed as the diluted, destabilized emulsion separates. Separator 61 may be a settling tank in which the phases separate under gravity or a smaller secondary desalter in which separation takes place by gravity with the assistance of an electrostatic field. Separation in settling tank may optionally be promoted with the use of an electrostatic coalescence unit 65 in which the coalescence of the water droplet occurs, hence facilitating the separation of the aqueous phase from the water phase in the settling tank following the coalesce.

The secondary oil phase passes out from the secondary separation sub-unit through line 62 to be blended into the primary desalted oil in line 51 for further processing in the refinery. Alternatively, the secondary oil phase, optionally with other streams blended into it, may be sent directly to one or more of the refinery process units for further processed, e.g. in a coker, gasifier or used as a feedstock for any other processing options such as distillation, deasphalting, FCC, coking, hydroprocessing, hydrocracking or blending. If the secondary oil phase composition differs from the primary oil phase it may become necessary to take the composition of the secondary oil phase (and possibly, the products derived from it) into consideration in the appropriate selection of the destination of the secondary oil phase. The secondary water phase leaves the settling tank through line 63 and is combined with the brine effluent from the desalter vessel in line 64, normally to be sent to the waste water treatment plant.

The dilution ratio may be selected to ensure the formation of water continuous or an oil continuous diluted emulsion. Typically, the diluted emulsion comprises 1 to 70 vol % of the desalter emulsion and 30 to 99% vol of diluent, preferably 1 to 50 vol % of desalter emulsion, most preferably 1 to 30 vol %. The amount of diluent is typically selected to reduce the viscosity of the diluted emulsion by 10%, preferably 30%, most preferably 50%. The dilution ratio may also be chosen to meet a predetermined concentration of solids in the diluted emulsion so as to optimize the release of the solids into the water phase for removal with the brine stream. Depending upon the nature of the emulsion, which itself is dependent on the crude oil composition, the oil/water ratio used in the desalter and the operation of the desalter, the withdrawn emulsion may be mixed with one or both of the oil and water diluents to the emulsion and optimize the subsequent separation into the secondary oil and water phases in the settling tank. Thus, the withdrawn portion of the emulsion is diluted and mixed with at least one diluent/destabilizing liquid, including but not limited to, an aqueous liquid such as water which may be fresh water, wash water, process water or a mixture of these. Process water is preferred as being conveniently available in the refinery. Hydrocarbon-containing fluids which may be used include the desalted crude, fuels such as FCC naphtha, FCC diesel, Light Catalytically Cracked Cycle Oil, Light Vacuum Gas Oil, Heavy Vacuum Gas Oil, hydroprocessed naphtha, hydrocracked naphtha, jet fuel, diesel fuel, atmospheric tower bottoms, coker naphtha, coker diesel, Light Coker Gas Oil, Heavy Coker Gas Oil and mixtures of these streams. Preferably, the hydrocarbon stream is the desalted crude which is immediately at hand in the desalter unit.

The invention claimed is:

1. A petroleum desalter which comprises:

(i) a desalter vessel having a feed inlet for admitting a mixture of crude oil to be desalted with desalting water to form a settled water layer containing salts dissolved from the oil in a lower portion of the vessel, a settled supernatant desalted oil layer in an upper portion of the vessel and an intermediate emulsion layer formed from the oil and the water, (ii) a water outlet at a bottom of the desalter vessel for removing water from the water layer in the lower portion of the vessel, (iii) a desalted oil outlet at a top of the desalter vessel for removing desalted oil from the oil layer in the upper portion of the vessel, (iv) one or more emulsion outlets in the vessel for removing emulsion from the emulsion layer, (v) a mixer connected to the emulsion outlet(s) for mixing the withdrawn emulsion with a diluent liquid, (vi) a separator connected to the mixer for separating the mixture of withdrawn emulsion and added diluent to form separated oil and water phases, the separator having an outlet for the separated oil phase and an outlet for the separated water phase, (vii) a crude oil feed line for conducting a crude oil feed to the desalter vessel, (viii) a wash water feed line for conducting wash water to the crude oil feed line, (ix) a mixing valve for mixing the crude oil with wash water, and (x) a line connecting the wash water feed line to the mixer to conduct wash water from the wash water feed line to the mixer.

2. A desalter according to claim 1, further comprising a line connected to the desalted oil outlet to conduct desalted oil to the mixer.

3. A desalter according to claim 1 in which the separator comprises a settling tank.

4. A desalter according to claim 1 which includes a line connecting the separated oil outlet of the separator to a desalted crude oil line connected to the desalted oil outlet at the top of the desalter vessel, to conduct the separated oil phase from the separator to the desalted crude oil line.

5. A desalter according to claim 1 which includes a line connecting the separated water outlet of the separator to a water line connected to the water outlet at the bottom of the desalter vessel, to conduct the separated water phase from the separator to the water line.

6. A petroleum desalter comprising:

(i) a desalter vessel having a feed inlet for admitting a mixture of crude oil to be desalted with desalting water to form a settled water layer containing salts dissolved from the oil in a lower portion of the vessel, a settled supernatant desalted oil layer in an upper portion of the vessel and an intermediate emulsion layer formed from the oil and the water, (ii) a water outlet at the bottom of the desalter vessel for removing water from the water layer in the lower portion of the vessel, (iii) a desalted oil outlet at the top of the desalter vessel for removing desalted oil from the oil layer in the upper portion of the vessel, (iv) one or more emulsion outlets for removing emulsion from the emulsion layer, (v) a mixer connected to the one or more emulsion outlets for mixing the withdrawn emulsion with a diluent liquid, (vi) a separator connected to the mixer for separating the mixture of withdrawn emulsion and added diluent to form separated oil and water phases, the separator having an outlet for the separated oil phase and an outlet for the separated water phase, wherein the separator comprises an electrostatic coalescer and a settling tank in sequence.

7. A petroleum desalter comprising:

(i) a desalter vessel having a feed inlet for admitting a mixture of crude oil to be desalted with desalting water to form a settled water layer containing salts dissolved from the oil in the lower portion of the vessel, a settled supernatant desalted oil layer in the upper portion of the vessel and an intermediate emulsion layer formed from the oil and the water, (ii) a water outlet at the bottom of the desalter vessel for removing water from the water layer in the lower portion of the vessel, (iii) a desalted oil outlet at the top of the desalter vessel for removing desalted oil from the oil layer in the upper portion of the vessel, (iv) one or more emulsion outlets for removing emulsion from the emulsion layer, (v) a mixer connected to the one or more emulsion outlets for mixing the withdrawn emulsion with a diluent liquid, (vi) a separator connected to the mixer for separating the mixture of withdrawn emulsion and added diluent to form separated oil and water phases, the separator having an outlet for the separated oil phase and an outlet for the separated water phase, wherein the separator comprises a secondary desalter vessel.

* * * * *